US007748648B2

(12) United States Patent
Songbe et al.

(10) Patent No.: US 7,748,648 B2
(45) Date of Patent: Jul. 6, 2010

(54) DISPENSING MEMBER FOR A FLUID PRODUCT, DISPENSER COMPRISING SUCH A DISPENSING MEMBER AND USE OF SUCH A DISPENSING MEMBER

(75) Inventors: Jean-Pierre Songbe, St Pierre en Val (FR); Bernard Clerget, Haudivillers (FR)

(73) Assignee: Rexam Dispensing Systems S.A.S. (FR)

( * ) Notice: Subject to any disclaimer, the term of this patent is extended or adjusted under 35 U.S.C. 154(b) by 0 days.

(21) Appl. No.: 11/854,371

(22) Filed: Sep. 12, 2007

(65) Prior Publication Data

US 2008/0061165 A1 Mar. 13, 2008

(30) Foreign Application Priority Data

Sep. 12, 2006 (FR) ..... 06 07960

(51) Int. Cl.
*B05B 1/34* (2006.01)

(52) U.S. Cl. ..... 239/468; 239/490; 239/492

(58) Field of Classification Search ..... 239/468, 239/469, 474, 475, 486–497, 473, 476, 482–485, 239/499, 501, 506, 518, 331–334
See application file for complete search history.

(56) References Cited

U.S. PATENT DOCUMENTS 4,979,678 A * 12/1990 Ruscitti et al. ..... 239/466
2006/0086828 A1 4/2006 Bougamont et al.

FOREIGN PATENT DOCUMENTS

| | | |
|---|---|---|
| FR | 2643574 A1 | 8/1990 |
| FR | 2 767 798 | 3/1999 |
| FR | 2853635 A1 | 10/2004 |
| FR | 2871533 A1 | 12/2005 |

OTHER PUBLICATIONS

French Search Report, Apr. 11, 2007, 2 pages.

* cited by examiner

*Primary Examiner*—Christopher S Kim
(74) *Attorney, Agent, or Firm*—St. Onge Steward Johnston & Reens LLC

(57) ABSTRACT

Dispensing member for a fluid product comprising a post and a spray nozzle, said post having an abutment surface and said spray nozzle comprising a transverse wall, an outlet orifice extending across said transverse wall, said outlet orifice being delimited by a lateral surface, at least one duct for supplying the fluid product to the outlet orifice, the said supply duct being delimited by the transverse wall and the abutment surface, being supplied with fluid product via a supply channel, emerging substantially tangentially relative to the lateral surface of the outlet orifice, and forming the only fluidic communication between the supply channel and the outlet orifice.

18 Claims, 6 Drawing Sheets

DISPENSING MEMBER FOR A FLUID PRODUCT, DISPENSER COMPRISING SUCH A DISPENSING MEMBER AND USE OF SUCH A DISPENSING MEMBER

CROSS-REFERENCE TO RELATED APPLICATIONS

The present application claims priority of French patent application No. 06 07960 filed on Sep. 12, 2006, the content of which is incorporated herein by reference.

FIELD OF THE INVENTION

The invention relates to a dispensing member for a fluid product, a dispenser comprising such a dispensing member and a use of such a dispensing member.

BACKGROUND OF THE INVENTION

In particular, the invention relates to a dispensing member for a fluid product comprising a post and a spray nozzle, said post having an abutment surface and said spray nozzle comprising: a transverse wall, an outlet orifice extending across said transverse wall, said outlet orifice being delimited by a lateral surface of revolution about an axis of revolution substantially perpendicular to the transverse wall, at least one duct for supplying the fluid product to the outlet orifice, the said supply duct being delimited by the transverse wall and the abutment surface, and extending in a plane perpendicular to the axis of revolution, between an upstream end suitable for being supplied with fluid product via a supply channel and a downstream end.

This type of dispensing member usually comprises a swirl chamber from which the outlet orifice extends. The swirl chamber is particularly delimited by a lateral surface which extends parallel to the axis of revolution and which has a dimension, measured perpendicularly to the axis of revolution, greater than that of the outlet orifice.

The supply duct extends tangentially to the swirl chamber and the downstream end of the supply duct leads into the lateral surface of the swirl chamber.

The fluid product is carried along under pressure into the swirl chamber in which it is made to rotate before leaving the dispensing member through the outlet orifice in the form of a spray consisting of individual droplets and having a conical shape with a determined spray angle.

Such a dispensing member poses problems for the spraying of a viscous fluid product, that is to say a fluid product having a viscosity greater than 0.001 Pa·s.

Specifically, the swirl chamber increases the friction surfaces to which the fluid, particularly viscous, product can adhere, which causes pressure losses for the fluid product and a reduction of the pressure with which the fluid product is carried along.

The fluid product comes out of the dispensing member in the form of a spray comprising droplets of various dimensions, capable of being large, and whose spray angle is reduced, for example to 10°, even in the form of a jet.

The invention aims to solve the above mentioned problems.

Furthermore, document FR-2 767 798 discloses a dispensing member of the aforementioned type in which the post can be moved relative to the spray nozzle between a forward position and a backward position. In the backward position, the outlet orifice is in fluidic communication with the supply channel via first supply ducts extending substantially tangentially to the lateral surface of the outlet orifice and second supply ducts offset from the first supply ducts in the direction of the axis of revolution and extending between the first supply ducts perpendicularly to the axis of revolution. The downstream end of the said first and second supply ducts leads directly into the lateral surface of the outlet orifice, but the said second supply ducts do not extend tangentially to the lateral surface of the outlet orifice. In the forward position, the transverse wall is in contact with the abutment surface, so that the first and second supply ducts are reduced to nothing, the fluid therein is expelled therefrom and the communication between the supply channel and the outlet orifice is broken.

SUMMARY OF THE INVENTION

The invention proposes a dispensing member of the aforementioned type in which the supply duct extends substantially tangentially relative to the lateral surface of the outlet orifice, leads directly into the lateral surface of the outlet orifice, and the transverse wall is in contact with the abutment surface along a surface substantially perpendicular to the axis of revolution at a distance from the supply duct, while simultaneously delimiting the supply duct which places the outlet orifice in fluidic communication with the supply channel.

Therefore, according to the invention, the outlet orifice is in fluid communication with the supply channel only via the supply duct(s) extending substantially tangentially relative to the lateral surface of the outlet orifice and leading directly into the lateral surface of the outlet orifice.

The direction of the supply duct generates a swirl movement of the fluid in the outlet orifice and the absence of swirl chamber makes it possible to limit the friction surfaces and the pressure losses for the fluid product and to retain the pressure carrying the fluid product along. On leaving the dispensing member, the fluid product may break up into fine droplets and form a spray having the desired spray angle.

In particular embodiments, the dispensing member may have, in a complementary manner where necessary, one or more of the following dispositions:

the outlet orifice comprises an upstream end and a downstream end, the downstream end of the supply duct leading to the vicinity of the upstream end of the outlet orifice;

the lateral surface of the outlet orifice is of circular section;

the lateral surface of the outlet orifice is of elliptical section;

the lateral surface of the outlet orifice is cylindrical;

the lateral surface of the outlet orifice is frustoconical;

the spray nozzle comprises a single supply duct;

the supply duct is delimited by a bottom surface, an external lateral edge and an internal lateral edge, the lateral edges being substantially perpendicular to the bottom surface and converging toward one another from the upstream end to the downstream end;

the transverse wall comprises internally a boss coming into contact with the abutment surface and a peripheral chamber surrounding the boss, the outlet orifice passing through the boss, the boss comprising a groove delimiting the supply duct so that the upstream end of the said supply duct leads into the peripheral chamber;

the spray nozzle also comprises a lateral wall of association which extends in the vicinity of the periphery of the transverse wall, substantially perpendicularly to the said transverse wall;

the dispensing member comprises a body comprising a housing having the abutment surface, said supply channel being suitable for supplying the housing with fluid product, the spray nozzle being placed in the housing, the transverse wall delimiting the housing towards the outside.

Furthermore, the invention proposes a dispenser comprising:

a reservoir having an opening and inside which a fluid product is placed, a dispensing device mounted in the opening and comprising a stem that can be moved in translation, in fluidic communication with the reservoir and suitable for dispensing the pressurized fluid product, a dispensing member as defined above, mounted on the stem in order to move the said stem, the supply channel being in fluidic communication with the stem.

The fluid product placed inside the reservoir may have a viscosity equal to 10 Pa·s or less.

In addition, a further subject of the invention is a use of the dispensing member as defined above, in order to spray a fluid product that has a viscosity equal to 10 Pa·s or less.

BRIEF DESCRIPTION OF THE DRAWINGS

Other objects and advantages of the invention will appear on reading the following description made with reference to the appended drawings in which.

DETAILED DESCRIPTION OF THE INVENTION

In the figures, the same reference numbers indicate identical or similar elements.

Figure 1:
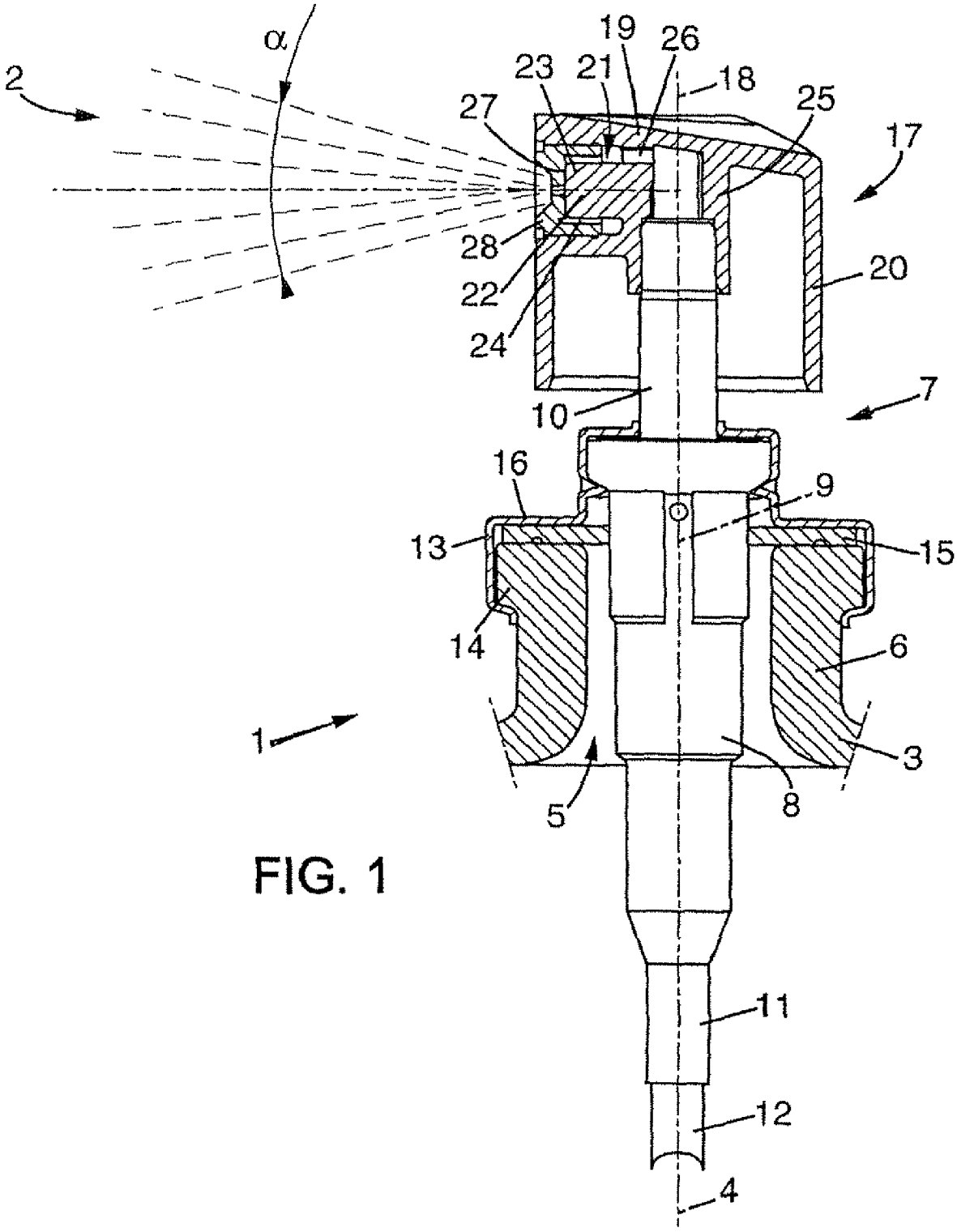
FIG. 1 is a partial view in longitudinal section of a fluid product dispenser comprising a dispensing member incorporating a spray nozzle.

FIG. 1 represents a dispenser 1 allowing the spraying of a fluid product, that is to say the dispensing of the fluid product in the form of a spray 2 consisting of individual droplets and of generally conical shape having a determined spray angle $\alpha$.

The dispenser 1 comprises a reservoir 3 inside which the fluid product is placed. The reservoir 3 may comprise a bottom and a generally cylindrical wall which extends about an axis 4 perpendicular to the bottom. The reservoir 3 has an opening 5 provided at the opposite end from the bottom and delimited, for example, by a tubular neck 6 which extends substantially coaxially with the axis 4 of the reservoir 3.

A dispensing device 7 mounted in the opening 5 of the reservoir 3 is suitable for drawing off the fluid product inside the reservoir 3 and delivering it under pressure to the outside.

In the rest of the description, the terms "bottom" or "lower" and "top" or "upper" will be understood with reference to the orientation of the reservoir 3 resting on the bottom. The terms "upstream" and "downstream" will be understood with reference to the direction of travel of the fluid product from the reservoir to the outside.

The dispensing device 7 may comprise a tubular body 8 that extends along an axis 9 and a hollow stem 10 mounted in the open top end of the body 8. The stem 10 can be moved partly inside the body 8 in translation along the axis 9. The bottom end, also open, of the body 8 is in fluidic communication with the reservoir 3, for example by means of a tubular wall of attachment 11 receiving a dip tube 12 by sleeve-fitting.

In particular examples, the dispensing device 7 may be actuated manually. The dispensing device 7 may be a valve mounted on the reservoir 3, that is then pressurized, and in which the stem 10 comprises at least one closable orifice that can be placed in fluidic communication with the inside of the body 8. As a variant, the dispensing device 7 may be a pump comprising a compression chamber delimited by an inlet valve close to the bottom end of the body 8, an outlet valve and a piston fixedly attached to the base of the stem 10 and able to be moved in a sealed manner inside the body 8.

The dispensing device 7 is attached coaxially to the neck 6 of the reservoir 3. The free bottom end of the dip tube 12 resting close to the bottom of the reservoir 3 so as to place the stem 10, whose top edge protrudes relative to the opening 5 of the reservoir 3, in fluidic communication with the reservoir 3. The stem 10 may therefore deliver the fluid product under a pressure, for example greater than 2 bar.

In other embodiments not shown, it would be possible to make provision for the reservoir 3 to have a bottom opening 5 and for the dispensing device 7 to operate in a reverse manner, that is to say with the stem 10 that extends downwards. In this case, the dip tube 12 is replaced by an appropriate drawing-off device.

In the embodiment shown, a fastening member fastens the dispensing device 7 to the reservoir 3. For example, in FIG. 1, the fastening member is a metal hoop 13 that is swaged, on the one hand, onto a collar fixedly attached to the body 8 of the dispensing device, and, on the other hand, to a rim 14 of the neck 6. It is possible to make provision to interpose a seal 15 between the top surface of the neck 6 and a radial surface 16 of the hoop 13. However, the fastening of the dispensing device 7 to the reservoir is not limited to this embodiment.

In order to actuate the dispensing device 7 by moving the stem 10 inside the body 8, a dispensing member, for example in the form of a push button 17, may be mounted on the top end of the stem 10.

The push button 17 comprises a generally cylindrical body that extends along an axis 18. The body has a top actuation wall 19 which extends substantially radially relative to the axis 18 of the push button 17 and from the edge of which a lateral skirt 20 extends along the axis 18 of the push button 17.

In the vicinity of the actuation wall 19, the body of the push button 17 may comprise a cylindrical housing 21 along an axis 22 generally perpendicular to the axis 18 of the push button 17, made in the lateral skirt 20, open towards the outside and having an abutment surface. In particular, inside the housing 21, a cylindrical post 23 may extend coaxially with the axis 22 of the housing 21 so as to form inside the cylindrical housing 21 a substantially annular space 24. The post 23 has a downstream end surface 27 forming the abutment surface that extends generally perpendicularly to the axis 22 of the housing 21.

The push button 17 also comprises a supply channel in fluidic communication with the stem 10. The supply channel may comprise, for example, an axial sleeve 25 that extends from the actuation wall 19 inside the skirt 20 along the axis 18 of the body, and a radial passageway 26 that is generally perpendicular to the axis 18 of the body and whose upstream and downstream ends lead respectively into the axial sleeve 25 and into the annular space 24 of the housing 21.

The bottom end of the axial sleeve 25 may be attached, for example by sleeve-fitting, to the top end of the stem 10. An annular protrusion may be provided on the inner wall of the axial sleeve 25 in order to improve the attachment and/or the seal of the push button 17 on the stem 10.

The supply channel makes it possible to supply the housing 21 with pressurized fluid product delivered via the stem 10.

In other embodiments, it is however possible to provide that the axis 22 of the housing 21 and the supply channel are parallel, while being or not being indistinguishable from the axis 18 of the dispensing member in order to allow an axial dispensing of the fluid product. In addition, the dispensing member may form an end-piece mounted on a dispensing device 7 or directly on the reservoir 3.

To allow the pressurized fluid product to come out in the form of a spray 2 consisting of fine individual droplets, a spray nozzle 28 is placed in the housing 21.

In particular, the spray nozzle 28 comprises a transverse wall 29 that has an upstream face 33 and a downstream face 34.

The spray nozzle 28 also comprises an outlet orifice 30 that extends across the transverse wall 29 between an upstream end and a downstream end arranged on the downstream face of the transverse wall 29 and through which the spray nozzle 28 leads to the outside of the dispenser 1.

The outlet orifice 30 is delimited by a lateral surface 35 of revolution about an axis of revolution A substantially perpendicular to the transverse wall 29.

The lateral surface 35 of the outlet orifice 30 therefore has a segment generated by rotation of a generatrix about the axis of revolution A, along a closed directing curve. The lateral surface 35 may however have a succession of such adjacent segments, similar or different, in which succession, for two respectively upstream and downstream adjacent segments, the outlet section of the upstream segment forms the inlet section of the downstream segment. Each segment may be straight, the generatrix being substantially rectilinear, or curved, the generatrix having a continuous curvature.

To carry the pressurized fluid product from the annular space 24 of the housing 21 to the outlet orifice 30, the spray nozzle 28 comprises at least one supply duct 36 that extends in a plane perpendicular to the axis of revolution A between an upstream end, in fluidic communication with the radial passageway 26 by means of the annular space 24, and a downstream end. Each supply duct 36 extends tangentially relative to the lateral surface 35 of the outlet orifice 30 and the downstream end of each supply duct 36 leads directly into the lateral surface 35 of the outlet orifice 30.

Each supply duct 36 may be delimited by a bottom surface 38 and an internal lateral edge 39 and an external lateral edge 40 substantially perpendicular to the bottom surface 38. Provision may be made for the lateral edges 39, 40 to converge toward each other from the upstream end to the downstream end of the supply duct 36. The lateral edges 39, 40 may, for example, converge toward each other with an angle of convergence lying between 10° and 30°, particularly 20°.

In particular, the external lateral edge 40 may be substantially rectilinear and be connected tangentially to the lateral surface 35 of the outlet orifice 30. And the internal lateral edge 39, also substantially rectilinear, may be connected to the lateral surface 35 of the outlet orifice 30 while being inclined relative to a direction parallel to the external lateral edge 40.

Figure 2:
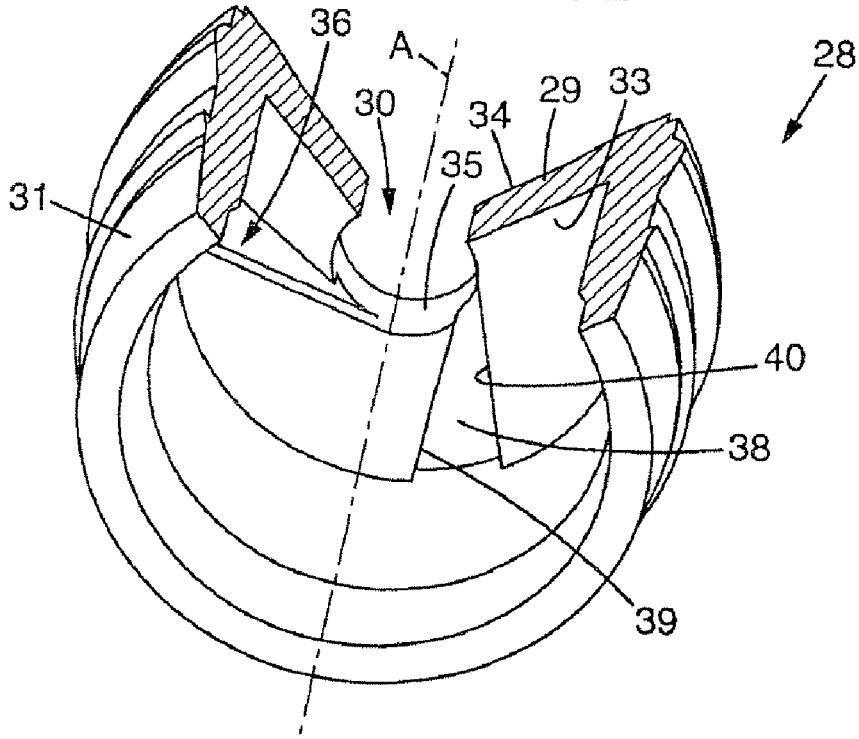
FIG. 2 is an enlarged view in perspective partially cut away representing a first embodiment of the spray nozzle of FIG. 1 on an upstream face.

In a first embodiment shown in FIGS. 1 and 2, the upstream face 33 has a generally flat transverse surface. The upstream end of the outlet orifice 30 may be arranged in the transverse surface of the transverse wall 29. The lateral surface 35 of the outlet orifice 30 may be cylindrical, the segment of the lateral surface 35 being straight with a generatrix parallel to the axis of revolution A. In addition, the closed directing curve of the said straight segment may be a circle so that the lateral surface 35 of the outlet orifice 30 may have a cross section relative to the axis of revolution A that is circular of constant diameter.

Furthermore, in FIG. 2, the spray nozzle 28 comprises several equally distributed supply ducts 36 whose downstream ends lead to the vicinity of the upstream end of the outlet orifice 30. In particular, the supply ducts 36 may be formed by grooves made directly on the transverse wall 29 from the transverse surface.

Figure 3:
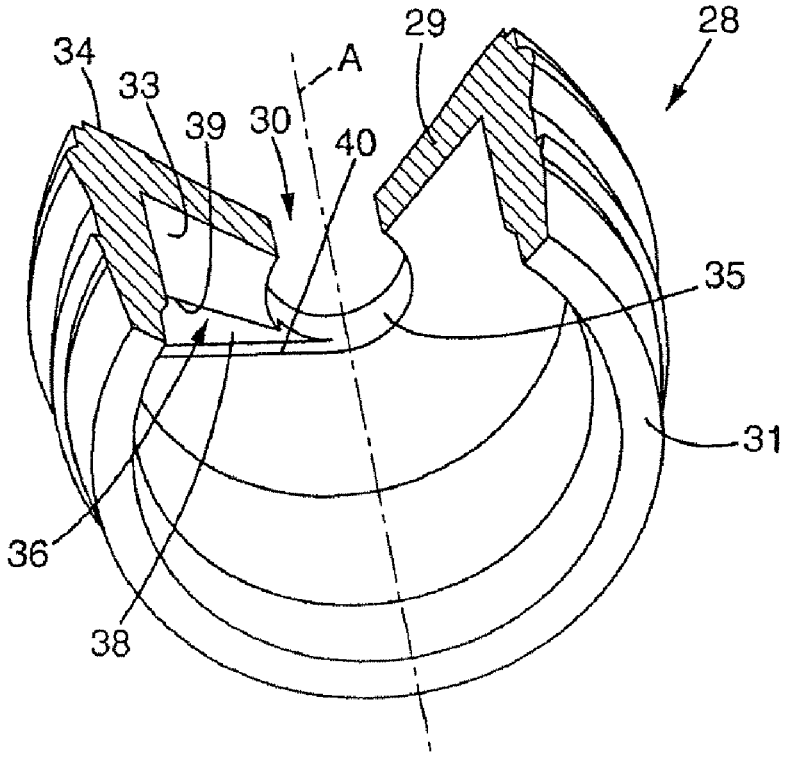
FIG. 3 is a view in perspective partially cut away representing a variant of the spray nozzle of FIG. 2 on the upstream face.
Figure 4:
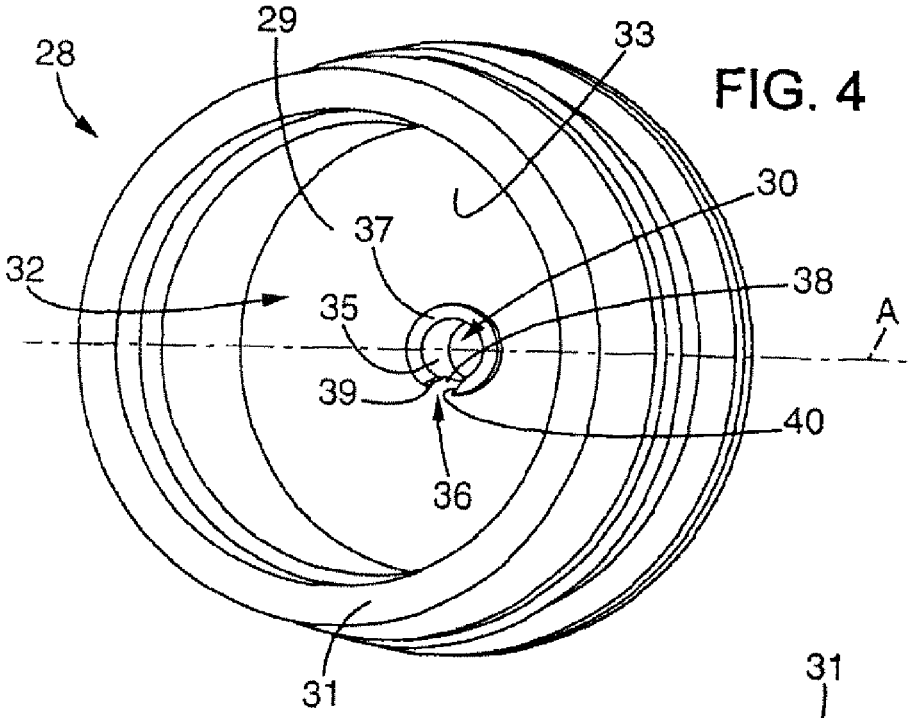
FIG. 4 is an enlarged view in perspective representing a second embodiment of the spray nozzle of FIG. 1 on the upstream face.
Figure 5:
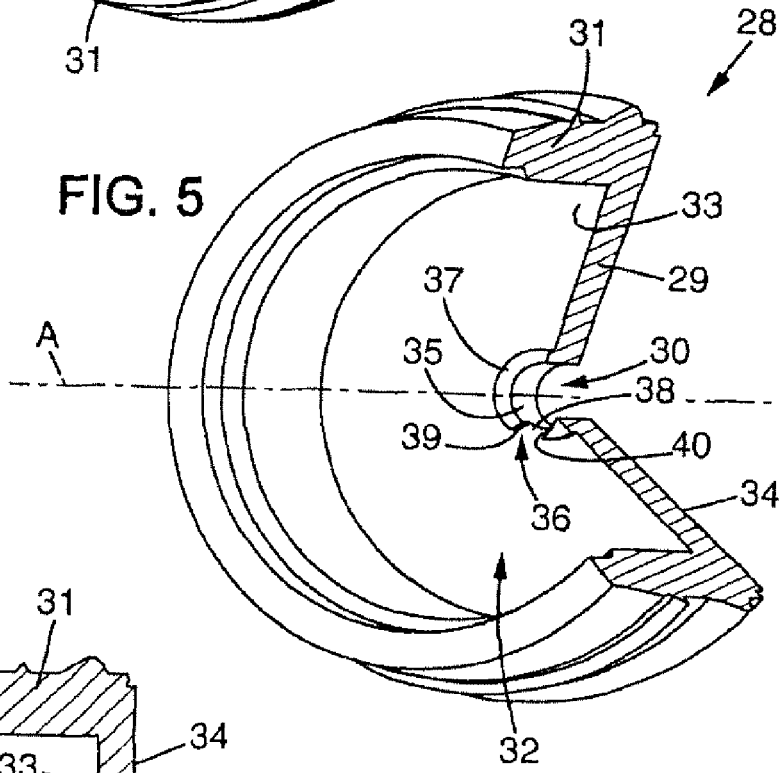
FIG. 5 is a view in perspective, partially cut away, of the spray nozzle of FIG. 4 on the upstream face.
Figure 6:
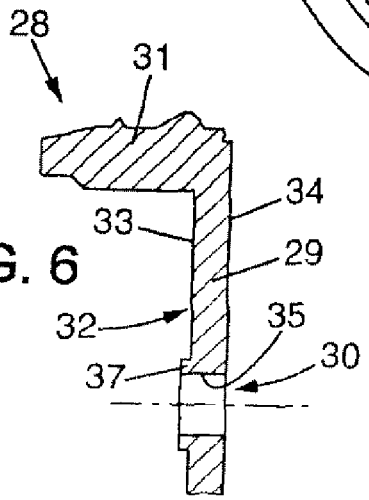
FIG. 6 is a partial view in longitudinal section of the spray nozzle of FIG. 4.

As a variant shown in FIG. 3, in order to limit the surfaces of contact of the fluid product with the spray nozzle 28 and therefore the pressure losses for the fluid product, provision is made for the spray nozzle 28 to be able to comprise only one supply duct 36.

In a second embodiment represented in FIGS. 4 to 11, the transverse wall 29 may comprise internally a boss 37, for example made in one piece with the transverse wall 29, protruding from the transverse surface. The transverse wall 29 may also comprise a peripheral chamber 32 surrounding the boss 37 so as to be delimited by the transverse surface and the boss 37.

The outlet orifice 30 may pass through the boss 37 so as to extend between the downstream face 34 of the transverse wall 29 and the upstream end provided at a distance from the transverse surface. The boss 37 then has an internal surface that belongs to the lateral surface 35 of the outlet orifice 30.

The boss 37 may comprise a single groove delimiting the single supply duct 36. The bottom surface 38 of the supply duct 36 may be substantially coplanar with the transverse surface of the transverse wall 29. In this manner, the downstream end of the supply duct 36 leads to the vicinity of the upstream end of the outlet orifice 30 and the upstream end of the supply duct 36 leads into the peripheral chamber 32.

As a variant, the boss 37 may comprise several grooves each delimiting a supply duct 36.

The spray nozzle 28 described above, having no swirl chamber, makes it possible to limit the surfaces of contact of the fluid product with the spray nozzle 28 and to reduce the dimensions of the space requirement of the spray nozzle 28.

According to particular dispositions, it is possible to provide, as an example, that the spray nozzle 28 has the following dimensions, without being limited thereto:

the distance between the upstream and downstream ends of the supply duct 36 may lie between 0.15 mm and 0.7 mm, the outlet orifice 30 may have a diameter lying between 300 μm and 800 μm and a length, measured along the axis of revolution A, lying between 0.45 mm and 1.10 mm, the downstream end of the supply duct 36 may have a height, measured along the axis of revolution A, lying between 0.25 mm and 0.60 mm and a width, measured perpendicularly to the axis of revolution A and in its narrowest portion, lying between 0.10 mm and 0.20 mm.

As a variant, provision is made for the lateral surface 35 of the outlet orifice 30 to be convergent from the upstream end to the downstream end. The lateral surface 35 of the outlet orifice 30 then has a cross section relative to the axis of revolution that reduces from the upstream end to the downstream end which makes it possible in particular to reduce the size of the droplets of the spray 2.

Figure 7:
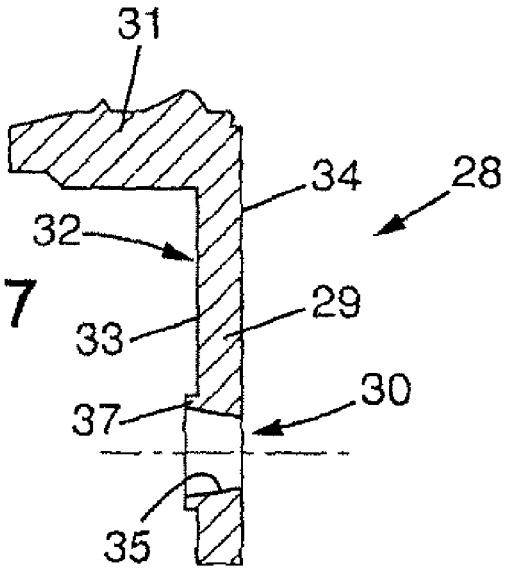
FIG. 7 is a partial view in longitudinal section of a first variant of the spray nozzle of FIG. 4.
Figure 8:
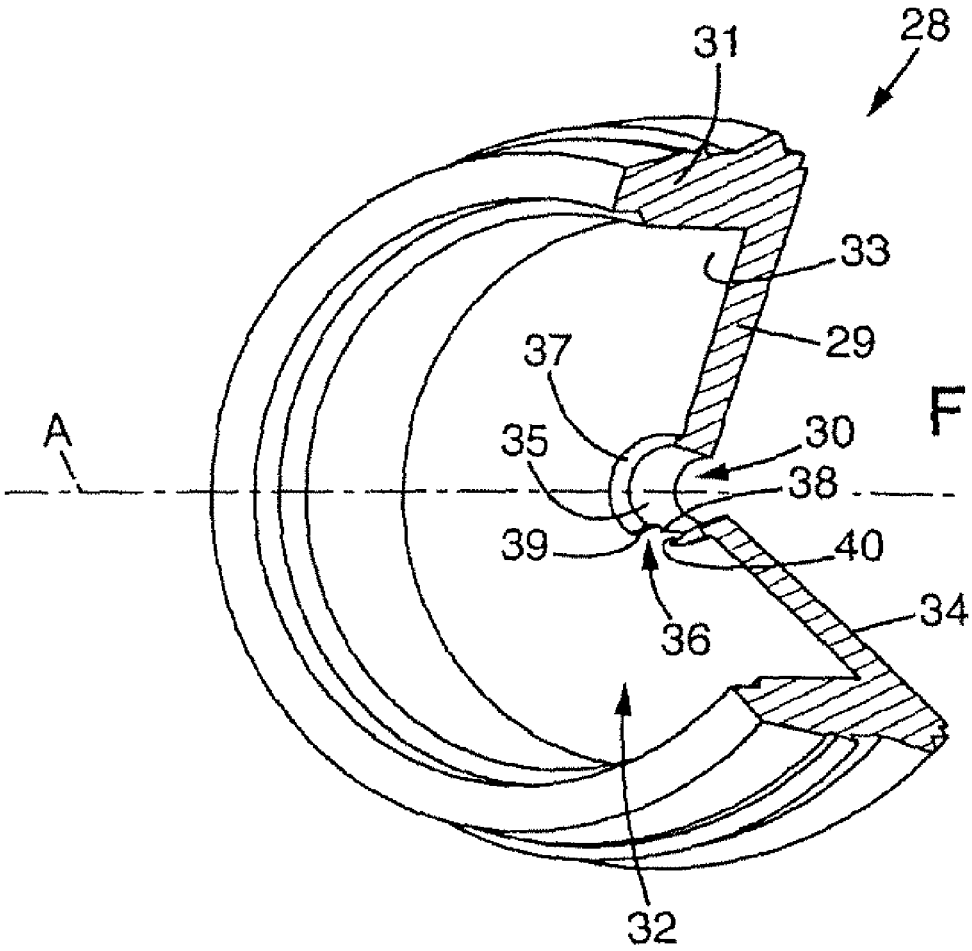
FIG. 8 is a view in perspective, partially cut away, of the spray nozzle of FIG. 7 on the upstream face.

In particular, in FIGS. 7 and 8, the lateral surface 35 of the outlet orifice 30 may be frustoconical, the segment of the lateral surface 35 being straight with a generatrix that is inclined relative to the axis of revolution, and convergent, the generatrix moving closer to the axis of revolution A from the upstream end to the downstream end.

According to another variant, the lateral surface 35 of the outlet orifice 30 may be divergent from the upstream end to the downstream end. The outlet orifice 30 then has a cross section relative to the axis of revolution A that increases from the upstream end to the downstream end which makes it possible in particular to reduce the spray angle $\alpha$ of the spray 2.

Figure 9:
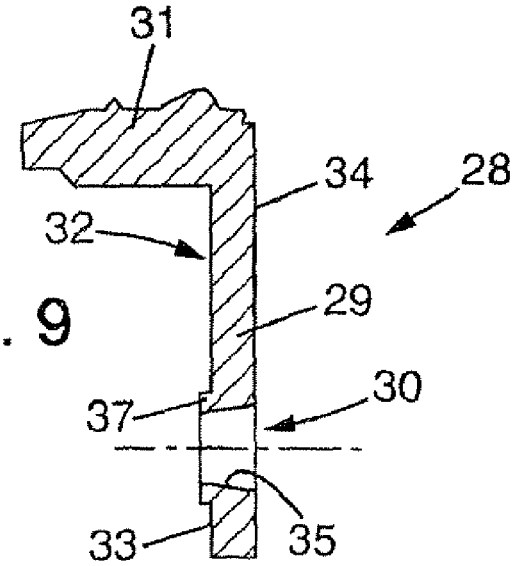
FIG. 9 is a partial view in longitudinal section of a second variant of the spray nozzle of FIG. 4.
Figure 10:
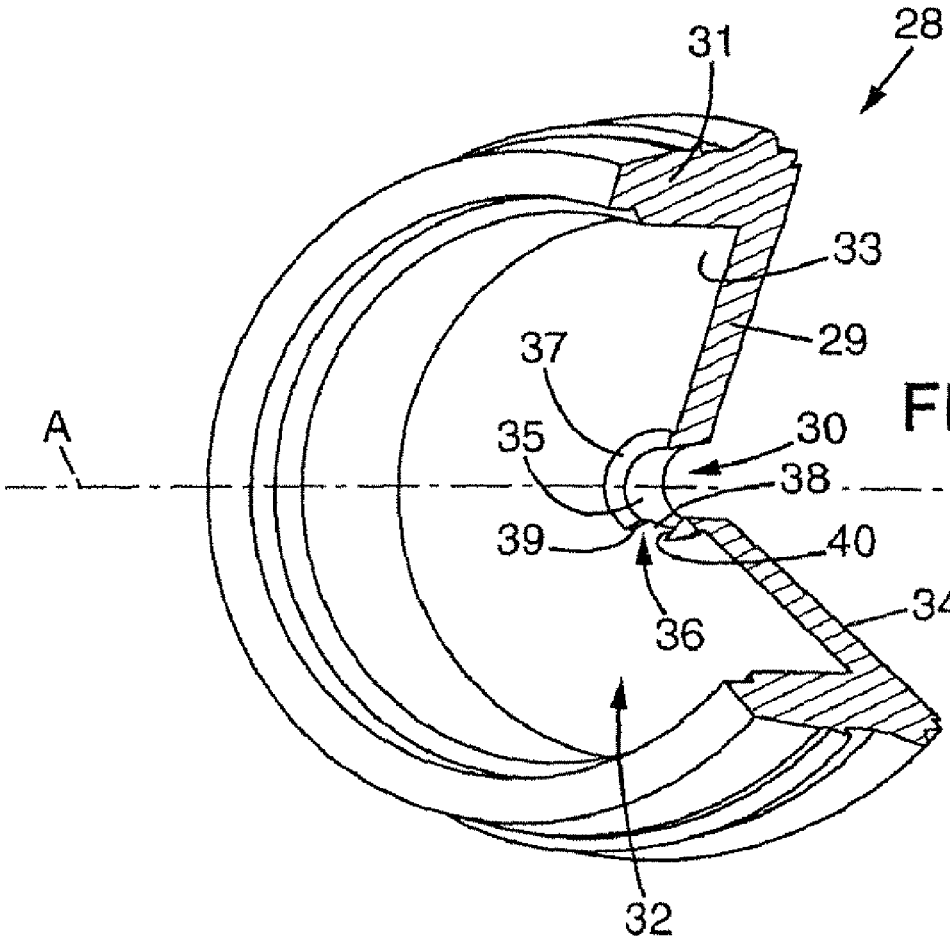
FIG. 10 is a view in perspective, partially cut away, of the spray nozzle of FIG. 9 on the upstream face.

In particular, in FIGS. 9 and 10, the lateral surface 35 of the outlet orifice 30 may be frustoconical and divergent, the generatrix moving away from the axis of revolution A from the upstream end to the downstream end.

In addition, to allow the formation of a spray 2 in the form of a cone having circular sections over its whole length and a uniform distribution of the droplets in each of the said sections, it is possible to provide that the closed directing curve of the segment or segments of the lateral surface 35 of the outlet orifice 30 is an ellipse so that the lateral surface 35 has an elliptical section.

Figure 11:
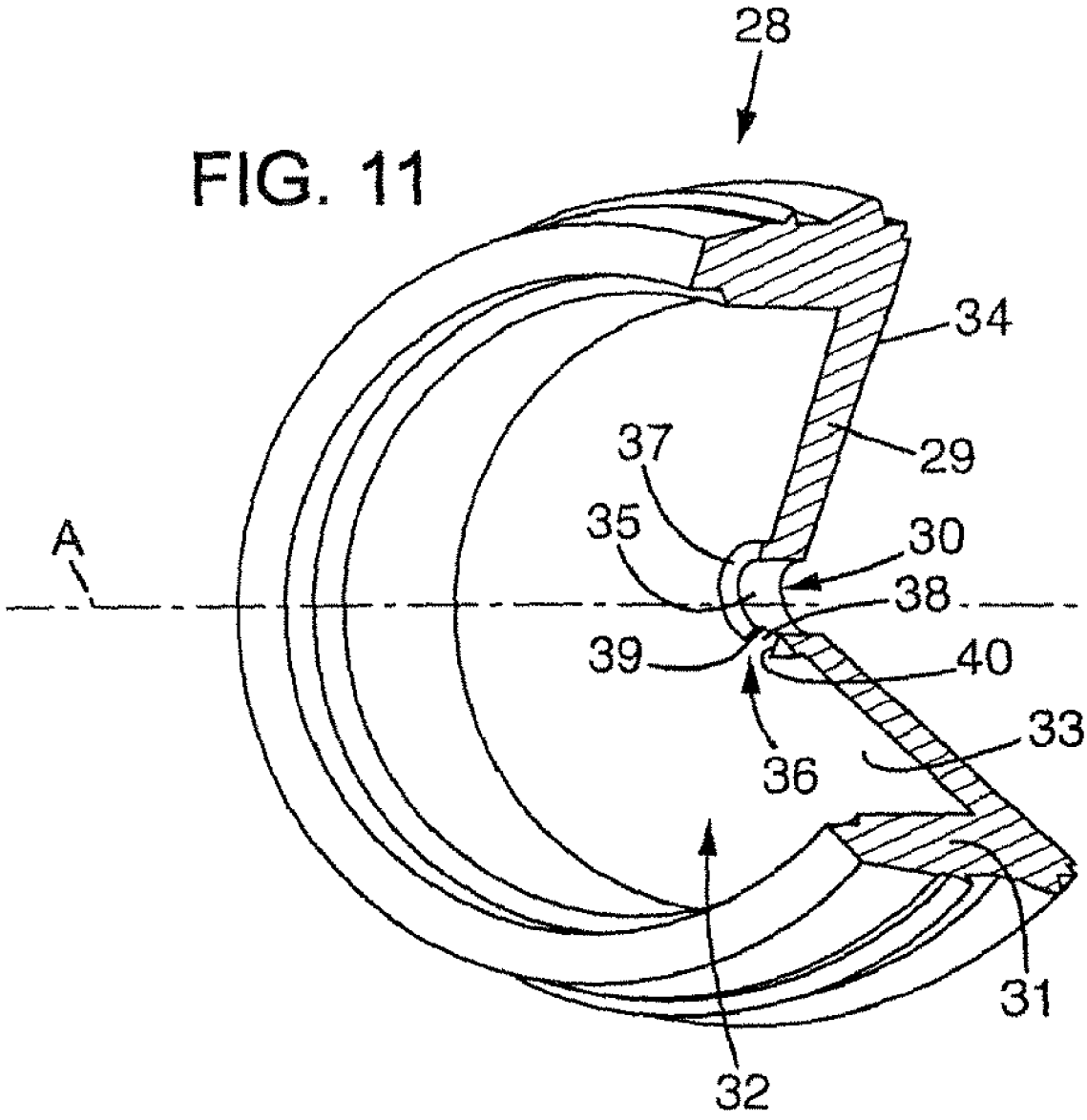
FIG. 11 is a view in perspective, partially cut away, of a third variant of the spray nozzle of FIG. 4 on the upstream face.

Actually, the single supply duct produces a dissymmetrical supply of the fluid product in the outlet orifice 30, which may generate a dynamic imbalance of the fluid product made to rotate in the outlet orifice 30. Such an imbalance risks causing a non-uniform distribution of the pressure and speed of the fluid product in the outlet orifice 30 which results in the formation of a spray 2 of non-circular and non-uniform section. The disposition according to which the lateral surface 35 of the outlet orifice 30 has an elliptical section, as shown in FIG. 11, makes it possible to balance the dissymmetrical supply and avoid the appearance of the dynamic imbalance of the fluid product. In particular, the supply duct 36 may extend tangentially to the lateral surface 35 in the vicinity of the large axis of the ellipse.

This arrangement may however be used in order to create or accentuate the dynamic imbalance and produce a spray 2 of elliptical section suitable for dispensing fluid product such as make-up foundations or other make-up products. As a variant, the supply duct may extend tangentially to the lateral surface to the vicinity of the small axis of the ellipse.

The spray nozzle 28 may form a fitted element that is sleeve-fitted into the housing 21. The transverse wall 29 may then comprise a lateral wall of association 31 that extends to the vicinity of the periphery of the transverse wall 29 substantially perpendicularly to the transverse wall 29.

The wall of association 31 of the spray nozzle 28 is sleeve-fitted inside the cylindrical housing 21 parallel to the axis 22 of the housing 21, the transverse wall 29 coming opposite the abutment surface 27. One or more flanges may be provided between the external periphery of the wall of association 31 and the housing 21 in order to improve the fastening and/or the seal of the spray nozzle 28 in the housing 21.

The transverse wall 29 of the spray nozzle 28 may then delimit the housing 21 towards the outside and come into contact with the abutment surface 27 so that the abutment surface 27 closes the supply duct 36 opposite the bottom surface 38.

In particular, in the first embodiment, the transverse surface of the transverse wall 29 may come into contact with the abutment surface 27. And in the second embodiment, the boss 37 may come into contact with the abutment surface 27. In this second embodiment, the peripheral chamber 32 extends, in the spray nozzle 28, the annular space 24 of the housing 21.

The space of the housing of the dispensing member with which the upstream end of the supply duct 36 is in fluidic communication is not limited to the embodiment described above. In particular, this space may be obtained by a different embodiment and/or arrangement of the elements comprising the dispensing member or of other elements.

For example, as a variant, it is possible to provide that the spray nozzle 28 is made in one piece with the body of the dispensing member 17, the abutment surface 27 being fitted, for example by the insertion of a fitted post in the housing 21. This prevents the risks of expelling the spray nozzle 28 when spraying the fluid product.

Therefore, when a user presses on the top actuation wall 19 of the push button 17, the stem 10 moved downwards delivers the pressurized fluid product to the axial sleeve 25 and the radial passageway 26 of the supply channel to the annular space 24 of the housing 21.

The upstream end of the supply duct 36 is supplied with pressurized fluid product, which fluid product is then carried along tangentially into the outlet orifice 30 via the said supply duct 36. The fluid product may be made to rotate in the outlet orifice 30 and come out of the dispenser 1 in the form of the spray 2 consisting of fine individual droplets and with a generally conical shape with the desired spray angle $\alpha$, for example equal to 80° or less.

The spray nozzle 28 as described above may be used to spray any type of fluid product, for example a viscous fluid product, having a viscosity greater than 0.001 Pa·s. Provision is also made for the spray nozzle 28 to be able to be used to spray a fluid product that has a viscosity equal to 10 Pa·s or less.

The fluid product placed inside the reservoir 3 may therefore have a viscosity in the range given above.

The use of the spray nozzle 28 according to the embodiments described above makes it possible, due to the removal of spaces in which the fluid product can stagnate, to obtain the desired spray 2 from the beginning to the end of the actuation of the dispenser and right throughout the use of the dispenser 1.

What is claimed is:

1. A dispensing member for a fluid product comprising:

a post, said post having an abutment surface; and a spray nozzle, said spray nozzle comprising:

a transverse wall having an upstream surface and a downstream surface;

an outlet orifice extending across said transverse wall with a proximal end of said outlet orifice at the upstream surface and a distal end of said outlet orifice at the downstream surface, said outlet orifice being delimited by one single lateral surface of revolution about an axis of revolution substantially perpendicular to the transverse wall, wherein said lateral surface is rectilinear from the proximal end to the distal end;

at least one duct for supplying the fluid product to the outlet orifice, said at least one supply duct being delimited by the transverse wall and the abutment surface, said at least one duct extending in a plane perpendicular to the axis of revolution, between an upstream end suitable for being supplied with fluid product via a supply channel and a downstream end leading directly into the lateral surface of the outlet orifice, substantially tangentially relative to the lateral surface of the outlet orifice, wherein said transverse wall is in contact with the abutment surface along a surface substantially perpendicular to the axis of revolution, while delimiting the supply duct which places the outlet orifice in fluidic communication with the supply channel.

2. The dispensing member of claim 1, wherein the downstream end of said supply duct directly leading to the lateral surface of the proximal end of the outlet orifice.

3. The dispensing member of claim 1, wherein the lateral surface of the outlet orifice is of circular section.

4. The dispensing member according to claim 1, wherein the lateral surface of the outlet orifice is of elliptical section.

5. The dispensing member of claim 1, wherein the lateral surface of the outlet orifice is cylindrical.

6. The dispensing member of claim 1, wherein the supply duct is delimited by a bottom surface, an external lateral edge and an internal lateral edge, the lateral edges being substantially perpendicular to the bottom surface and converging toward one another from the upstream end to the downstream end.

7. The dispensing member of claim 1, wherein the spray nozzle also comprises a lateral wall of association which extends in the periphery of the transverse wall, substantially perpendicularly to said transverse wall.

8. The dispensing member of claim 1, comprising a body that comprises a housing having the abutment surface, said supply channel being suitable for supplying the housing with fluid product, the spray nozzle being placed in the housing, the transverse wall delimiting the housing towards the outside.

9. A Dispenser comprising:

a reservoir having an opening and inside which a fluid product is placed;

a dispensing device mounted in the opening and comprising a stem that can be moved in translation, in fluidic communication with the reservoir and suitable for dispensing the pressurized fluid product;

a dispensing member mounted on the stem in order to move said stem, the supply channel being in fluidic communication with the stem, wherein said dispensing member comprises:

a post, said post having an abutment surface; and a spray nozzle, said spray nozzle comprising:

a transverse wall having an upstream surface and a downstream surface;

an outlet orifice extending across said transverse wall with a proximal end of said outlet orifice at the upstream surface and a distal end of said outlet orifice at the downstream surface, said outlet orifice being delimited by one single lateral surface of revolution about an axis of revolution substantially perpendicular to the transverse wall, wherein said lateral surface is rectilinear from the proximal end to the distal end;

at least one duct for supplying the fluid product to the outlet orifice, said at least one supply duct being delimited by the transverse wall and the abutment surface, said at least one duct extending in a plane perpendicular to the axis of revolution, between an upstream end suitable for being supplied with fluid product via a supply channel and a downstream end leading directly into the lateral surface of the outlet orifice, substantially tangentially relative to the lateral surface of the outlet orifice, wherein said transverse wall is in contact with the abutment surface along a surface substantially perpendicular to the axis of revolution, while delimiting the supply duct which places the outlet orifice in fluidic communication with the supply channel.

10. The dispensing member of claim 9, wherein the fluid product placed inside the reservoir has a viscosity equal to 10 Pa·s or less.

11. A method of using a dispensing member, comprising the steps of:

spraying a fluid product that has a viscosity equal to 10 Pa·s or less, wherein said dispensing member comprises:

a post, said post having an abutment surface; and a spray nozzle, said spray nozzle comprising:

a transverse wall having an upstream surface and a downstream surface;

an outlet orifice extending across said transverse wall with a proximal end of said outlet orifice at the upstream surface and a distal end of said outlet orifice at the downstream surface, said outlet orifice being delimited by one single lateral surface of revolution about an axis of revolution substantially perpendicular to the transverse wall, wherein said lateral surface is rectilinear from the proximal end to the distal end;

at least one duct for supplying the fluid product to the outlet orifice, said at least one supply duct being delimited by the transverse wall and the abutment surface, said at least one duct extending in a plane perpendicular to the axis of revolution, between an upstream end suitable for being supplied with fluid product via a supply channel and a downstream end leading directly into the lateral surface of the outlet orifice, substantially tangentially relative to the lateral surface of the outlet orifice, wherein said transverse wall is in contact with the abutment surface along a surface substantially perpendicular to the axis of revolution, while delimiting the supply duct which places the outlet orifice in fluidic communication with the supply channel.

12. The dispensing member of claim 2, wherein the lateral surface of the outlet orifice is of circular section.

13. Dispensing member according to claim 2, wherein the lateral surface of the outlet orifice is of elliptical section.

14. The dispensing member of claim 1, wherein the duct includes an internal lateral edge and an external lateral edge which coverage toward each other, wherein the angle of convergence of said lateral edges is between 10° and 30°.

15. The dispensing member of claim 1, wherein the duct includes an internal lateral edge and an external lateral edge which coverage toward each other, wherein the angle of convergence of said lateral edges is about 20°.

16. The dispensing member according to claim 1, wherein the lateral surface of the outlet orifice is frustoconical.

17. The dispensing member according to claim 1, comprising a single supply duct.

18. The dispensing member according to claim 1, wherein the transverse wall comprises internally a boss coming into contact with the abutment surface and a peripheral chamber surrounding the boss, the outlet orifice passing through the boss, the boss comprising a groove delimiting the supply duct so that the upstream end of the said supply duct leads into the peripheral chamber.

* * * * *